US008808648B2

(12) United States Patent
Sarofim

(10) Patent No.: US 8,808,648 B2
(45) Date of Patent: Aug. 19, 2014

(54) DISPOSABLE FOR ANALYZING A LIQUID SAMPLE BY NUCLEIC ACID AMPLIFICATION

(75) Inventor: Emad Sarofim, Hagendorn (CH)

(73) Assignee: Roche Molecular Systems, Inc., Pleasanton, CA (US)

( * ) Notice: Subject to any disclaimer, the term of this patent is extended or adjusted under 35 U.S.C. 154(b) by 948 days.

(21) Appl. No.: 12/373,513

(22) PCT Filed: Jul. 5, 2007

(86) PCT No.: PCT/EP2007/005952

§ 371 (c)(1),
(2), (4) Date: Jan. 12, 2009

(87) PCT Pub. No.: WO2008/006501

PCT Pub. Date: Jan. 17, 2008

(65) Prior Publication Data

US 2010/0209304 A1 Aug. 19, 2010

(30) Foreign Application Priority Data

Jul. 14, 2006 (EP) ..... 06014683

(51) Int. Cl.

| | |
|---|---|
| ***B01L 3/00*** | (2006.01) |
| *B01L 7/00* | (2006.01) |
| *B01L 3/02* | (2006.01) |

(52) U.S. Cl.

CPC ..... *B01L 3/502715* (2013.01); *B01L 7/52* (2013.01); *B01L 2300/0636* (2013.01); *B01L 2200/027* (2013.01); *B01L 3/0275* (2013.01); *B01L 2300/0816* (2013.01); *B01L 2300/087* (2013.01); *B01L 2300/044* (2013.01); *B01L 3/502707* (2013.01)

USPC ..... 422/554; 422/551; 422/550

(58) Field of Classification Search

CPC ..... B01L 2300/0861
USPC ..... 422/554, 551, 550, 547
See application file for complete search history.

(56) References Cited

U.S. PATENT DOCUMENTS

| | | | | |
|---|---|---|---|---|
| 5,066,465 | A * | 11/1991 | Kano et al. | 422/412 |
| 6,818,185 | B1 | 11/2004 | Petersen et al. | |
| 2002/0168298 | A1 * | 11/2002 | Huhn et al. | 422/100 |
| 2005/0038357 | A1 | 2/2005 | Hartstein et al. | |

FOREIGN PATENT DOCUMENTS

| | | | |
|---|---|---|---|
| EP | 1346771 | A1 | 9/2003 |
| EP | 1346772 | A2 | 9/2003 |
| EP | 1346772 | A3 | 10/2003 |
| WO | 0128684 | A2 | 4/2001 |
| WO | 0128684 | A3 | 4/2001 |
| WO | 03057369 | A1 | 7/2003 |
| WO | EP2007005952 | | 10/2007 |

* cited by examiner

*Primary Examiner* — Natalia Levkovich
(74) *Attorney, Agent, or Firm* — M. Reza Savari

(57) ABSTRACT

The invention refers to a disposable sample holding and processing device (1) for being used in an apparatus for analyzing a liquid sample by nucleic acid amplification, especially polymerase chain reaction technique, comprising a device body (2) having a structured surface and a sealing cover (4) which covers the structured surface thereby forming a wall of an amplification chamber (5)), which amplification chamber (5) is designed and intended for performing nucleic acid amplification for analyzing the liquid sample, and a wall of an inlet channel (6) connected to the amplification chamber (5) for providing the amplification chamber (5) with liquid. According to the invention the device body (2) comprises a sheet (20) on which the structured surface forming the inlet channel (6) is arranged, and that the sheet (20) carries at least one rib (34, 35, 36) for increasing the stiffness of the device body (2).

8 Claims, 5 Drawing Sheets

DISPOSABLE FOR ANALYZING A LIQUID SAMPLE BY NUCLEIC ACID AMPLIFICATION

This application claims the benefit of priority under 35 U.S.C. §119of EP Application 06014683.4 filed Jul. 14, 2006 the entire content of which is hereby incorporated by reference.

The invention relates to a disposable sample holding and processing device for being used in an apparatus for analyzing a liquid sample by nucleic acid amplification, especially by Polymerase-Chain-Reaction Technique, comprising a device body having a structured surface and a sealing cover which covers the structured surface thereby forming

- a wall of an amplification chamber, which amplification chamber is designed and intended for performing nucleic acid amplification for analyzing the liquid sample, and
- a wall of an inlet channel connected to the amplification chamber for providing the amplification chamber with sample liquid.

Such a device is disclosed in U.S. Pat. No. 6,551,841 B1. The known device consists of a substrate of silicon or a polymeric material in which channels and chambers are formed. The substrate is covered by a cover made of glass or plastic which seals the channels and chambers between the substrate and the cover.

WO 01/28684 A2 discloses a disposable sample holding and processing device for performing nucleic acid amplification comprising a device body a sheet on which a structured surface is arranged an a sealing cover which covers the structured surface thereby forming amplification chambers an a wall of an inlet channel. In order to increase the stiffness of the device the sealing element is provided with ribs. Another disposable sample holding and processing device for performing nucleic acid amplification is disclosed in WO 03/057369 A1.

EP 1 346 771 A1 refers to a microplate for performing a polymerase chain reaction process having a plurality of uncovered open wells wherein ribs are located between the bottom of the wells and the outer wall of the frame surrounding the microplate in order to make the outer wall more rigid.

US 2005/0038357 A1 discloses a general type of sample element for holding a volume of bodily fluid in a sample chamber having thin walls (entitled "windows") enabling optical measurement of the sample comprised in the sample chamber. Stiffening ribs are integrally formed on the windows in order to assist in preserving the planarity of the windows which is a critical parameter for the accuracy of the analyte-concentration measurement.

In order to analyze large numbers of fluid samples by a nucleic acid amplification technique like polymerase chain reaction technique speed and cost of an analysis are important aspects of sample holding and processing devices. It is therefore an object of the present invention to provide a disposable sample holding and processing device suitable for analyzing a fluid sample at low cost and within a conveniently short time.

Upon this the following specific requirements have to be taken into account: The geometric conditions resulting from the channels and chambers comprised in the device, enabling the mechanical interfacing with the handling and actuation means of the (automatic) apparatus used for the analysis with the device and the use of a sealing cover which allows heat transfer for heating and cooling the sample, easy and low cost manufacturing, avoiding shrinkage, size deviation, forming of bubbles in the device body and the cover, high cost of the injection mold and long cycling time in the manufacturing process, enabling venting of the mold in the manufacturing process, optimization of the amount of material required for the body or the device, providing high stiffness of the device, in particular in view of its automated handling and processing upon use in an apparatus, and enabling an easy attachment of the sealing cover onto the device body.

These objects are solved according to the invention in that the device body comprises a sheet on which the structured surface forming the inlet channel is arranged, and that the sheet carries at least one rib for increasing the stiffness of the device body.

Disposable sample holding and processing devices according to the invention can be manufactured cheaply, preferably using polymeric materials. The sheet of the device body is stiffened by at least one, preferably several, ribs. This stiffening makes it possible to use a sheet with a thickness of less than 1.2 mm, preferably of 0.8 mm to 1.0 mm, for the device body. It can be achieved that the device according to the invention has a favorably low mass which on the one hand reduces material costs and on the other hand reduces the thermal capacity of the device. As an additional advantage the stiffening effect of a rib facilitates fixing a sealing cover, e.g. a foil, to the device body by welding without causing a bending of the device body by thermal strain.

A low thermal capacity is advantageous and important since nucleic acid amplification techniques require as a general rule sample processing at temperatures above room temperature and polymerase chain reaction technique, for example, cycling between carefully controlled temperatures. The favorably low thermal capacity of a device according to the present invention provides for shorter times for heating or cooling sample liquid contained in the device and thus faster analysis.

Furthermore the device according to the invention has the advantage that it can be processed in a vertical orientation in a nucleic acid amplification apparatus since the sheet of the device body stiffened by at least one rib has sufficient mechanical strength. By vertical processing of the disposable the required footprint for the instrument is reduced.

The sample to be analyzed by the device may be a body fluid, e.g. plasma, serum, urine, or any liquid gained by processing, mixing or other treatment of a body liquid. Other possibilities of samples include suspensions of biological material or any liquid containing an analyte.

Further details and advantages of the present invention are illustrated in the following based on an exemplary embodiment making reference to the attached drawings. The following is depicted in the figures.

Figure 1:
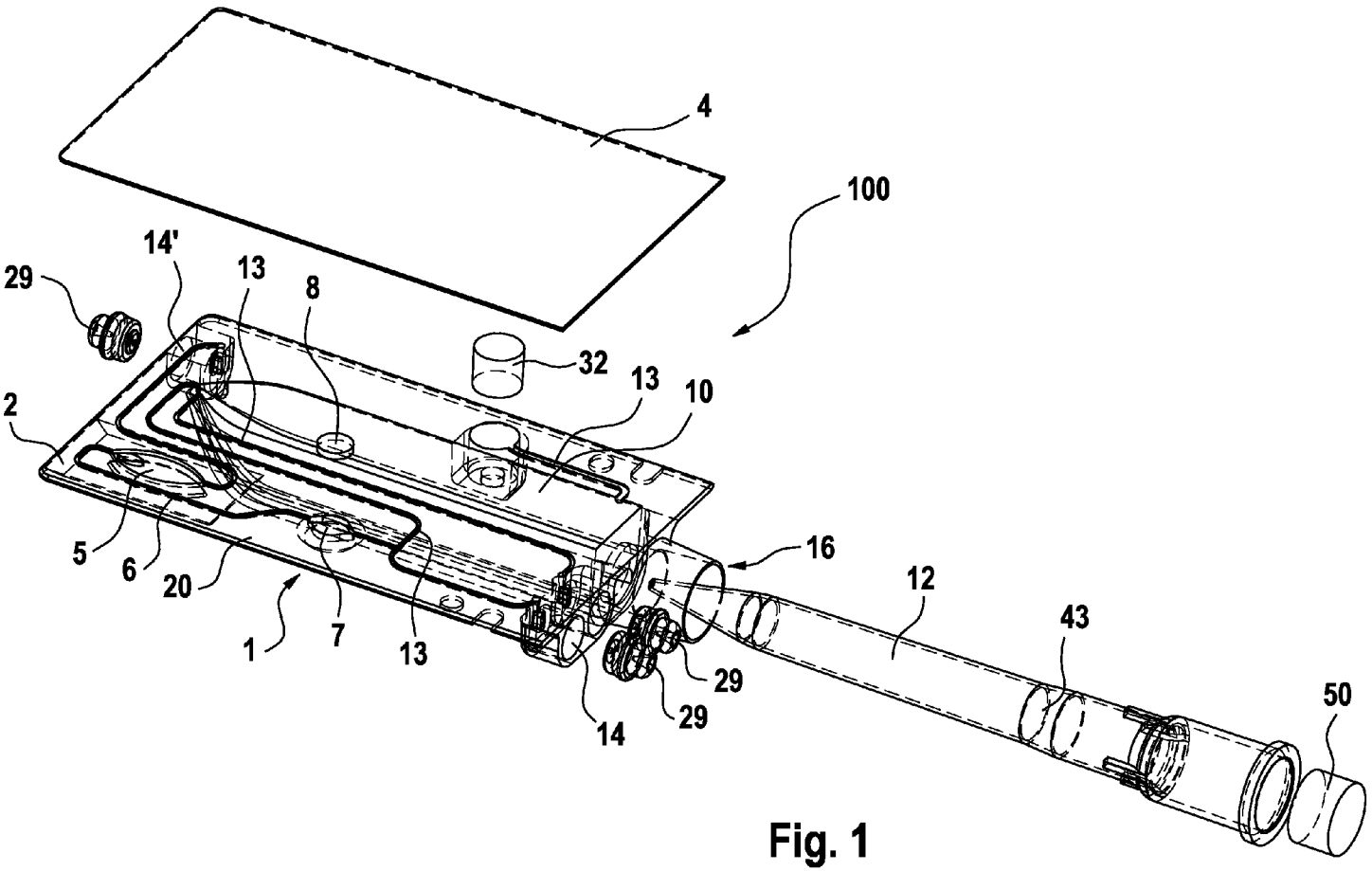
FIG. 1 shows an exploded view of an embodiment of a handling kit according to the invention comprising a disposable handling and processing device and a sample transfer tip.
Figure 2:
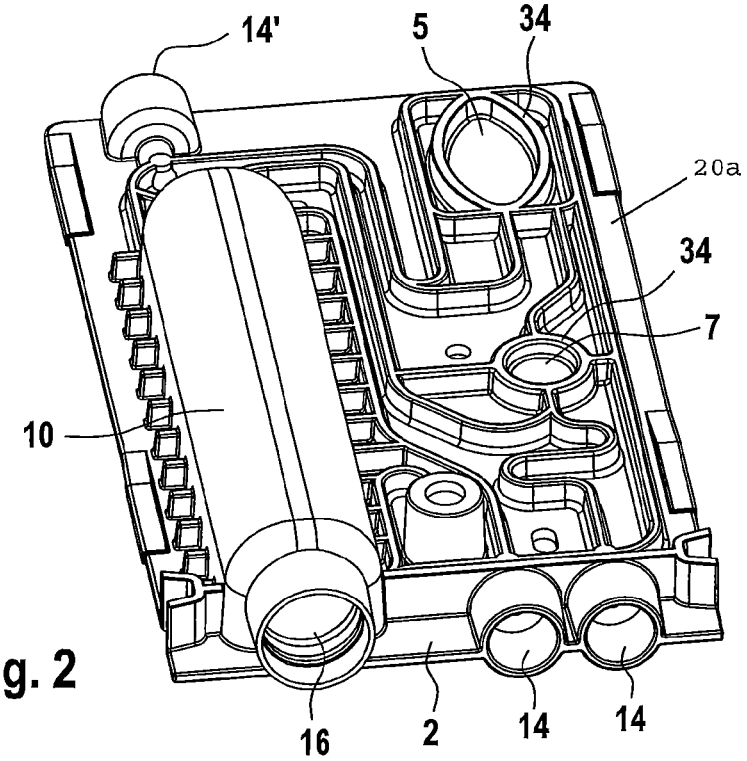
FIG. 2 shows a perspective view of the body of the disposable handling and processing device shown in FIG. 1.
Figure 3:
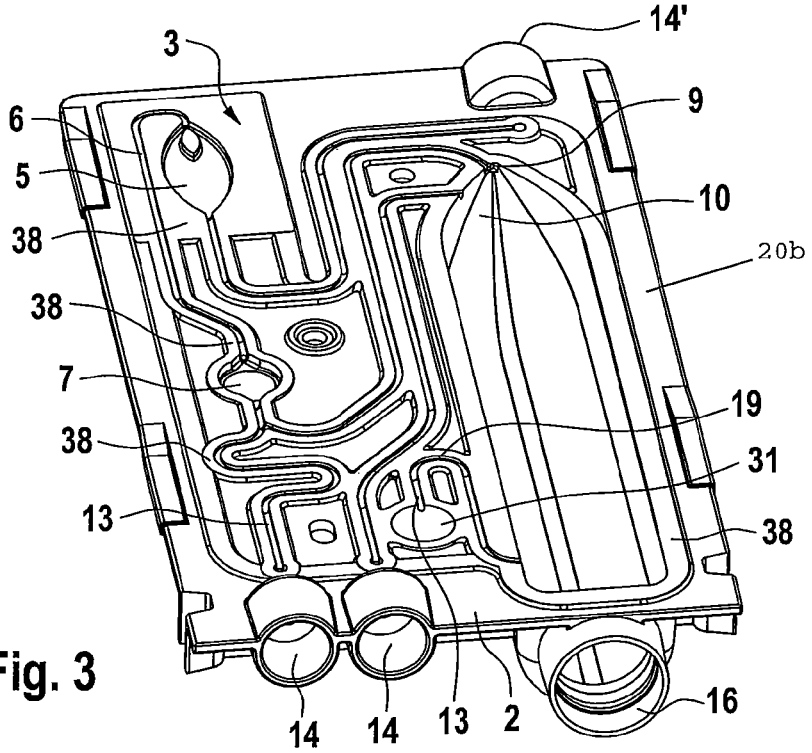
FIG. 3 shows another perspective view of the device body shown in FIG. 1.

FIG. 1 shows an exploded view of a handling kit 100 comprising a disposable handling and processing device 1 and a sample transfer tip 12. FIGS. 2 and 3 show the body 2 of the disposable sample holding and processing device 1, which is designed for being used in an apparatus for analyzing a liquid sample by nucleic acid amplification, especially by polymerase chain reaction technique, and therefore is dimensioned for insertion into such an apparatus. The device 1 comprises a device body 2 having a structured surface 3, which comprises grooves and depressions for channels and chambers, and a sealing cover 4 which covers the structured surface 3 thereby forming a wall of an amplification chamber 5 which is designed and intended for performing nucleic acid amplification and of an inlet channel 6 connected to the amplification chamber 5.

The device 1 also comprises a binding chamber 7 containing a solid phase adsorber 8, preferably a glass fiber fleece, for binding nucleic acids contained in the sample liquid. The device 1 also comprises a sample preparation chamber 10 with an insertion opening 16 adapted to receive the sample transfer tip 12. The sample preparation chamber 10 has an outlet 9 which is connected via a channel 13 to the binding chamber 7. The sample preparation chamber 10 has a volume of 50 μl to 20 ml, especially in the range of 200 μl to 10 ml, and is typically used for lysis of the sample material or, more generally, for a preparation step of the sample.

The various chambers 5, 7, 10 are connected by channels 13 with each other and/or to fluid interface ports 14, 14'. The binding chamber 7 has a volume of 5 μl to 500 μl, especially 10 μl to 100 μl. The amplification chamber 5 has a volume of 10 μl to 100 μl and is preferably at least as large as the volume of the binding chamber 7. The depth of the amplification chamber 5, the binding chamber 7, the channels 6 and 13 measured perpendicular to the sealing cover 4 is in the range of 50 μm to 2 mm, preferably 100 μm to 1 mm. The channels 6, 13 have a cross-section area of 0.01 $mm^2$ to 2 $mm^2$, especially 0.04 $mm^2$ to 0.5 $mm^2$.

Figure 4:
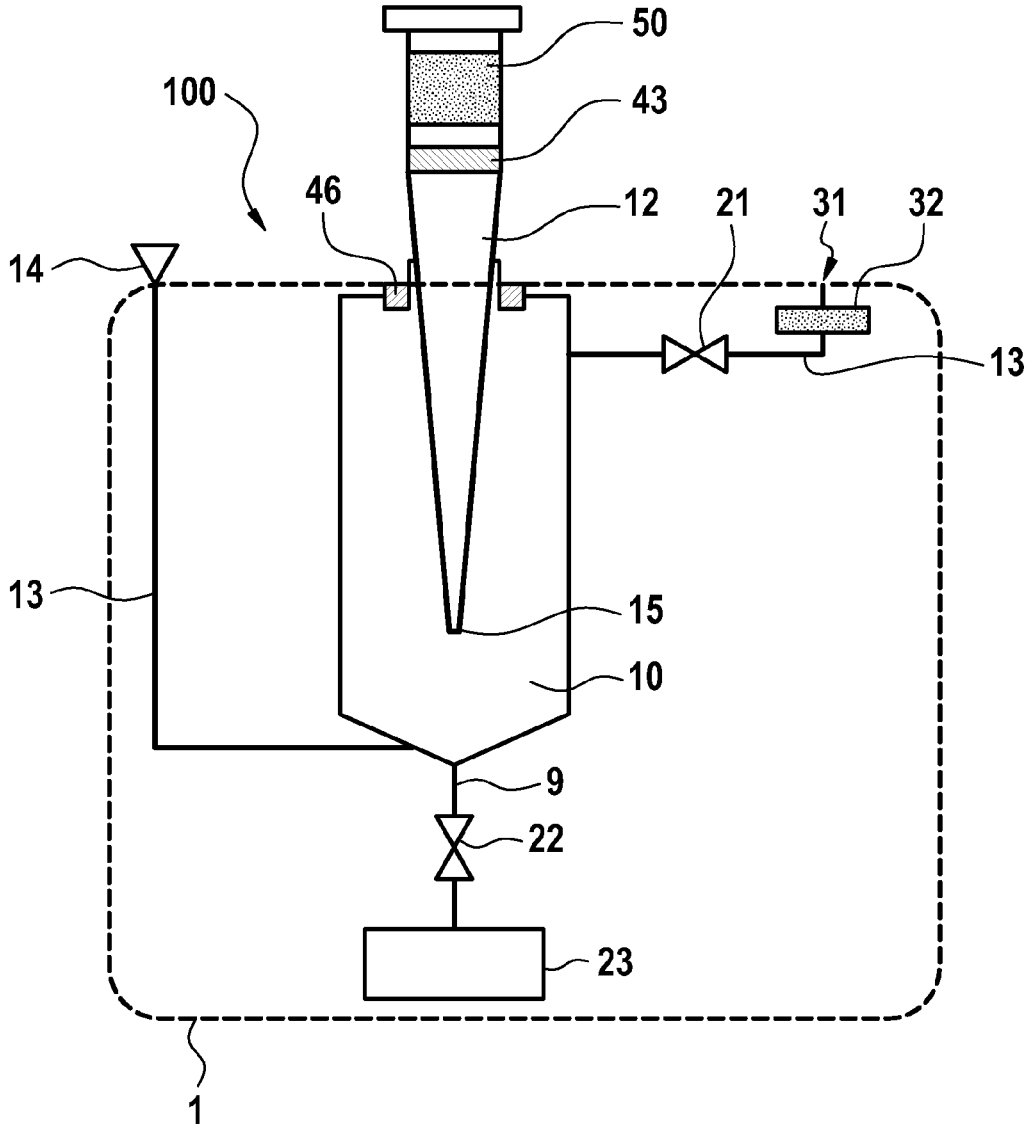
FIG. 4 shows a schematic sketch of the handling kit shown in FIG. 1.

FIG. 4 shows a schematic sketch of the function of the handling kit 100 comprising the device 1 and the sample transfer tip 12. Upon introduction of the tip 12 into the sample preparation chamber 10 the sealing area 43 of the tip and the sealing area 46 of the inner wall of chamber 10 form a tight seal. Reagents, e.g. for lysis, can be added to the sample preparation chamber 10 via the fluid interface port 14 and channel 13. A vent 31 which is closed by a filter 32 is also connected to the sample preparation chamber 10. The chamber 10 has an outlet 9 which leads to a fluidic system 23 which comprises the chamber 5 and 7 shown in FIGS. 1 to 3. Fluid control areas 21 and 22 can be used to close channels and thereby control the flow of gases or liquids. The fluid control areas may, for example, be closed by heat or pressure applied by an apparatus in which the handling kit 100 is used to analyze a sample.

The device body 2 comprises a sheet 20 made of a plastic material on which the structured surface 3 forming the channels 6, 13 and chambers 5, 7, 10 is arranged. The device body 2 is manufactured by injection molding. Suitable plastic materials, which are inert with respect to the sample liquid and to reagents are for example polypropylene, polyethylene, polystyrene, polycarbonate and polymethylmetacrylate. Preferably a thermo-plastic material is used, especially polypropylene.

The structured surface 3 of the device body 2 is overlaid by the flat sealing cover 4 thereby forming a wall of the chambers 5, 7, 10 and channels 6, 13 of the device 1 and sealing them tight. The sealing cover 4 is a thin sheet material, for example a plastic foil, which touches the device body 2 in sealing areas 38. Preferably, the sealing cover 4 comprises more than one layer. In the example shown, it comprises a first layer (preferably touching the device body 2) made of a material which is inert with respect to the sample liquid and a second layer (wherein preferably the first layer is placed between the device body 2 and the second layer) which is made of a metal, preferably aluminum. The second layer is preferably thicker than the first layer.

The second layer provides an efficient way for transporting heat to the sample liquid or away from it. For heating or cooling of the sample the sealing cover 4 can be connected to a heating or cooling area of an analysis apparatus. Preferably, the thickness of the sealing cover 4 is as small as possible while still ensuring sufficient mechanical strength for reliably sealing the various chambers 5, 7, 10 of the device 1. The lower the thickness of the sealing cover 4 is the lower is its thermal capacity and the higher is the heat transfer rate. A low thermal capacity, a high heat transfer conductivity and high heat transfer rate are advantageous as they enable faster heating and cooling of the device 1, respectively of fluids therein.

Generally, the thickness of the sealing cover 4 should not exceed 1 mm, preferably be below 500 μm. In order to ensure sufficient mechanical strength for a reliable sealing of the chambers 5, 7, 10 and of the channels 6, 13 the thickness should be at least 50 μm. Especially advantageous is a thickness of 50 μm to 350 μm, especially of 60 μm to 200 μm.

Aluminum is particularly well suited as material for the second layer of the sealing cover 4 as it has a very low thermal capacity. Of course, other materials can also be used. The thickness of the second layer is preferably 20 μm to 400 μm, especially 20 μm to 200 μm.

As the function of the first layer is mainly to prevent contact between sample liquid and the second layer it is advantageous to provide the first layer with a thickness as small as possible while still ensuring a continuous layer. The thickness of the first layer should therefore be less than 300 μm, preferably less than 200 μm, especially less than 100 μm. Particularly preferred is a thickness of the first layer of 0.1 μm to 80 μm.

In the example shown the sealing cover 4 is a composite foil comprising the first layer and the second layer. The first layer can be laminated to the second layer or sprayed, painted or, for example, vapor deposited on the second layer. More layers can be added to the sealing cover 4, for example a coat of paint to protect the second layer. The overall heat transfer conductivity of the sealing cover 4 is at least 200 $Wm^{-2}K^{-1}$, preferably at least 2000 $Wm^{-2}K^{-1}$.

The sealing cover 4 can be fixed to the device body 2 by means of suitable bonding procedures, e.g. by thermal sealing or by use of an adhesive, e.g. a polyurethane or polymethylmethacrylate adhesive. Preferably, the sealing cover 4 is bonded using thermal bonding or welded, for example by ultrasonic welding or laser welding, to the device body 2. Welding is most feasible if the first layer of the sealing cover 4 consists of the same material as the device body 2, e.g. polypropylene. The sealing cover 4 and the device body 2 have positioning holes (not shown) which are used during manufacturing for precise positioning of the sealing cover 4 on the structured surface 3.

For providing reagents to, respectively for leading fluids out of the device 1, the device 1 has fluid interface ports 14, 14' which are connected to the channels 6, 13 or chambers 5, 7, 10 of the device 1. The fluid interface ports 14 are arranged on a small area side which adjoins both to a large area front, on which the sealing cover 4 is arranged, and a large area back of the device 1. In the example shown the interface ports 14, 14' comprise a cylindrical recess for a septum 29.

As FIG. 3 shows the fluid interface ports 14 are closed by septa 29 to prevent contamination of the device 1. The septa 29 are made of a suitable elastomere which can be pierced by a hollow needle, syringe or a similar device to deliver reagents or process gases into the device 1. The elastomere used for the septa 29 has a shore hardness in the range of 20 to 80 Shore A, preferably in the range of 30 to 60 Shore A. The insertion opening of the sample preparation chamber 10 is also arranged on that small area side. This arrangement enables processing of the device 1 in a vertical position in an analysis apparatus.

The fluid interface port 14' is arranged on the same side as the inlet ports 14 or on a different small area side which also adjoins both to the large area front and the large area back of the device 1. The fluid interface port 14' is connected directly to the amplification chamber 5 and can be used as an outlet port for removing gas and/or liquid from the device 1. Preferably the outlet interface port 14' is arranged on a small area side opposite to the small area side on which the inlet fluid interface ports 14 are arranged.

In addition the device 1 has a vent 31 connected to the sample preparation chamber 10 via an insertion opening. The vent 31 is provided with means 19, 32 for blocking passage of liquid or solid particles to prevent contamination of a sample with dust, aerosols or the like and to prevent contamination of ambient with potentially dangerous sample material. These means comprise a filter material 32, preferably a porous material, which is placed in the vent 31. Alternatively or additionally the means may also comprise a tortuous section 19 a channel 13 which causes liquid or solid particles to adhere to curving channel walls so that such particles are thereby taken out of a gas flow. The tortuous section 19 is the more effective the more curves it comprises and the smaller their curving radii are. In the example shown the tortuous section 19 comprises only a single curve which suffices to provide a filtering effect.

The means 19, 32 for blocking passage of liquid or solid particles allow a gas exchange of the preparation chamber 10 with a surrounding atmosphere, usually air. In the device 1 shown a porous plastic material 32 is used to close the vent 31 which is placed on the back of the device 1.

The described disposable sample holding and processing device 1 is part of the handling kit 100 which also comprises the sample transfer tip 12 for transferring liquid into the disposable device. The handling kit 100 is shown in a back view in FIG. 5 and in a cross-section view along line CC of FIG. 5 in FIG. 6.

The sample transfer tip 12 is made of the same polymeric material as the body 2 of the disposable device 1, i.e. of polypropylene, although the sample transfer tip 12 could in principle also be made of a different material like glass. The disposable device 1 has a sample preparation chamber 10 with an insertion opening adapted to receive the sample transfer tip 12. The insertion opening and the sample transfer tip 12 are dimensioned in such a way that inserting the sample transfer tip 12 into the sample preparation chamber 10 causes a tight seal between an outer wall 40 of the sample transfer tip 12 and an inner wall 41 of the sample preparation chamber 10 The inner wall 41 of the sample preparation chamber 10 has a sealing area 46 which engages a sealing area 43 of the outer wall 40 of the sample transfer tip 12 to form the tight seal. The inner wall 41 and the sealing 43 of the sample preparation chamber 10 and the outer wall 40 of the sample transfer tip 12, between which the tight seal is formed, are circular. When the seal is in place the inner wall 41 of the sample preparation chamber 10 presses against the sample transfer tip 12. The outer diameter of the sample transfer tip 12 is typically in the range of 5 mm to 20 mm. In this way the sample transfer tip 12 can be used to pick up a sample from a blood collection tube or similar device where a sample may be stored.

Figure 6:
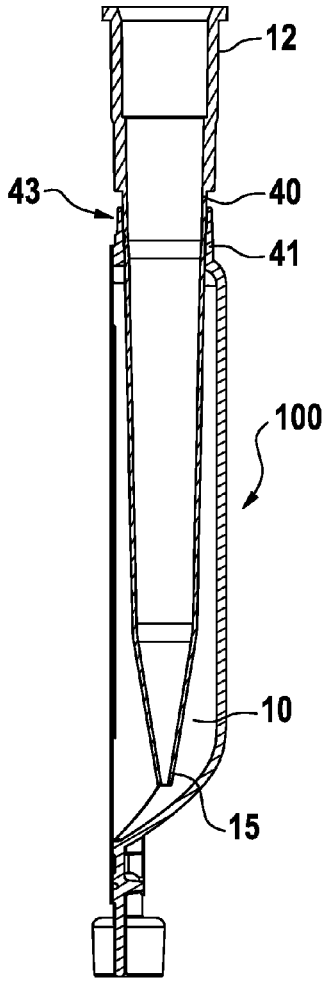
FIG. 6 shows a cross-section view of the FIG. 5 along the line CC.

The sample transfer tip 12 has an end 15 for insertion into an insertion opening of the sample preparation chamber 10. When the sample transfer tip 12 is introduced into the sample preparation chamber 10 as shown in FIG. 6 the end 15 of the sample transfer tip 12 is distanced from the insertion opening 16 (FIG. 1), i.e. its rim 11, by at least 1 cm, preferably at least 3 cm, especially at least 5 cm. Preferably, the distance between the end 15 of the sample transfer tip 12 an the sealing area 43 is larger than the immersion depth with which the sample transfer tip 12 is immersed in a sample liquid during a sample collection process when sample is taken from a sample reservoir, e.g. by aspiration.

After transfer of a sample to the sample preparation chamber 10 by means of the sample transfer tip 12, the tip 12 is friction locked in the device 1 by applying a suitable pushing force which pushes the tip 12 into its insertion position. This force is typically in the range of 2 N to 50 N, preferably between 5 N to 30 N. The friction lock between the sample transfer tip 12 in the insertion position and the disposable device creates a locking force of at least 2 N, preferably at least 5 N. Hence, a force of at least 2 N, preferably at least 5 N, would be necessary to pull the tip out of its insertion position. The sealing area 43 of the sample transfer tip 12 is provided as a frustum shaped section of the tip 12, but may easily be provided by different means.

The sample transfer tip 12 contains a plug 50 which is shown in FIG. 1 and made of a filter material, preferably a porous material. Fibrous materials, adsorptive materials, size exclusion materials and/or membranes may also be used. In the example shown the plug 50 is made of a porous plastic material. The plug 50 prevents contamination but is sufficiently permeable for air to communicate pressure and therefore allow sample aspiration and dosing as well as sip and spit mixing of sample liquid with reagents in the sample preparation chamber 10. The plug 50 filters aerosols from air which the device exchanges with a surrounding atmosphere.

Figure 5:
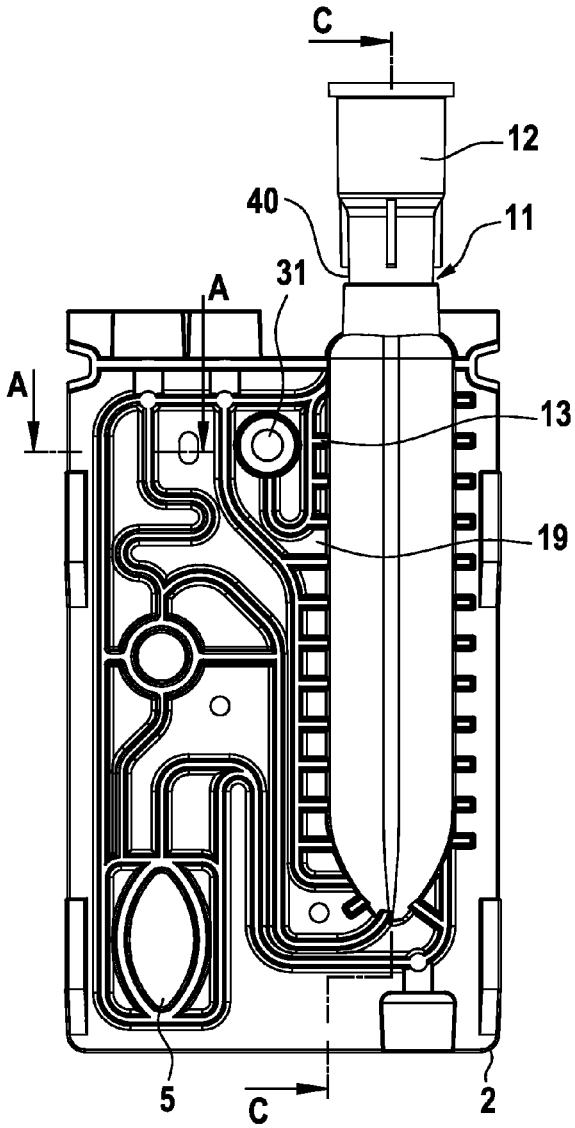
FIG. 5 shows a back view of the device body and inserted tip shown in FIG. 1.
Figure 7:
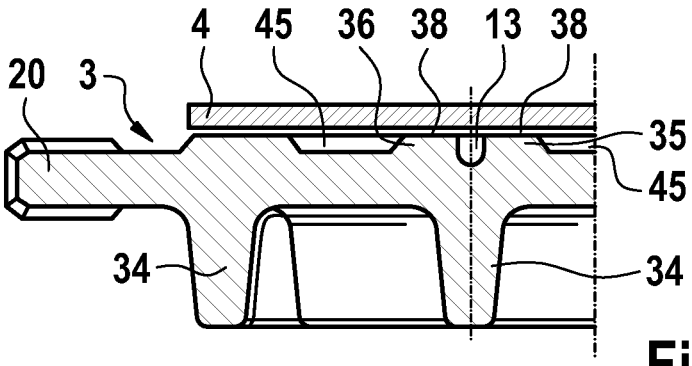
FIG. 7 shows a cross-section view of FIG. 4 along the line AA.

FIG. 7 shows a cross-section view along line AA of FIG. 5. As can be seen in FIG. 7 the sheet 20 carries at least one rib 34, 35, 36 for increasing the stiffness of the device body 2. The ribs 34, 35, 36 and the sheet 20 are manufactured as a single piece. In the device 1 shown ribs 34, 35, 36 are arranged both on the front side (i.e. on the structured surface 3 facing to the cover 4) of the sheet 20 and on the back side (the opposite side of the sheet 20 facing away of the sheet 20) of the sheet 20 for increased stiffness. Of course, a useful stiffening effect can also be achieved with ribs on either the front or back side of the sheet 20 only, or even by a single rib.

Figure 8:
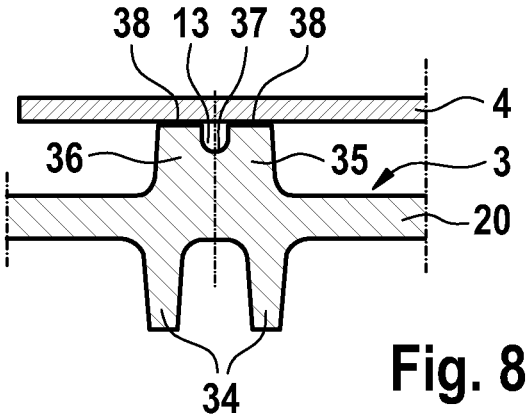
FIG. 8 shows a detail of another embodiment in a cross-section view corresponding to FIG. 7.

It is advantageous if at least one rib 35, 36 is arranged on the structured surface 3 such that at least one wall of a channel 6, 13 is formed by the rib. In the device 1 shown opposing walls of the channel 6 (or correspondingly of another channel 13), i.e. neighboring walls forming the channel 6 in between that walls, are formed by two corresponding ribs 35, 36 running parallel to each other. It is especially advantageous if the channel bottom 37 is elevated with respect to the surface of the sheet 20 adjacent to the ribs 35, 36, which form opposing walls of the channel 6, as shown in FIG. 8.

In similar fashion ribs 35, 36 or a raised section form sidewalls of the binding chamber 7 and the amplification chamber 5. The sealing cover 4 is fixed to the ribs 35, 36 on the front side of the sheet 20 and therefore touches the device body 2 only with a fraction of its surface area, which eases creation of a tight seal between the disposable body 2 and the sealing cover 4 and reduces bending of the device 1. As shown in FIGS. 7 and 8, ribs 35 and 36 have flat tops which are connected to the sealing cover 4. Thus pockets of air 45 exist between the sheet 20 and the cover 4. This provides for thermal insulation between the device body 2 and the sealing cover 4. At the same time an improved thermal connection between the sealing cover 4 and sample liquid is achieved as the sealing cover 4 forms a wall to the various channels 6, 13 and chambers 5, 7, 10 of the device 1.

The rib 34 or ribs on the back side of the sheet 20 are aligned with the inlet channel 6 or one or several other channels 13 on the front of the sheet 20 or with a chamber wall, no matter whether that channel 6, 13 or wall of a chamber 5, 7, 10 is straight or curved. Preferably the at least one rib 34 is parallel to a straight channel 6, 13 and/or to a straight portion of a channel 6, 13 and/or to a straight chamber wall. It is especially advantageous to arrange at least one the rib 34 or ribs on the back side of the sheet 20, i.e. on the side not covered by the sealing cover 4. Preferably, the at least one rib 34 is opposite of channels 6, 13 as shown in FIGS. 7 and 8 and/or the flat tops 38 in which the cover sheet 4 is connected to the device body 2. For additional stiffening further ribs may be added, especially on the back side of the sheet 20.

The sheet 20 has a thickness of 0.2 mm to 4 mm, especially 0.3 mm to 2 mm, preferably 0.5 mm to 1.5 mm, especially preferred of 0.8 mm to 1.0 mm. The ribs 34 on the back side of the sheet 20 have typically at half height a width which is 50% to 150% of the thickness of the sheet 20. The ribs 34 rise above the surface of the sheet 20 to a height which is 60% to 200%, preferably 80% to 150% of the thickness of the sheet 20. Ribs 35, 36 on the front side of the sheet 20 have a smaller height than ribs 34 on the back side of the sheet 20, i.e. ribs 35, 36 on the front side of the sheet 20 have preferably a height of 20% to 120% of the thickness of the sheet 20.

The differences in height between ribs 34 on the back side of the sheet 20 and ribs 35, 36 on its front side are largely due to differences in their function. Whereas ribs 34 serve only to increase the stiffness of the device body 2, ribs 35, 36 first and foremost serve to provide walls of one or several channels 6, 13 and/or to connect the device body 2 to the cover 4. Although the ribs 35, 36 are therefore much smaller in height they still provide a welcome stiffening effect.

REFERENCE NUMERALS

1 disposable sample holding and processing device
2 device body
3 structured surface
4 sealing cover
5 amplification chamber
6 inlet channel
7 binding chamber
8 solid phase adsorber
9 outlet of sample preparation chamber 10
10 sample preparation chamber
11 rim of insertion opening 16 of the sample preparation chamber 10
12 sample transfer tip
13 channels
14 interface port
14' interface port
15 end of the sample transfer tip 12
16 insertion opening of the sample preparation chamber
19 tortuous section of channel 13
20 sheet
20*a* back side of sheet 20
20*b* front side of sheet 20
21 fluid control area
22 fluid control area
23 fluidic system comprising channels 6, 13 and chambers 5, 7
29 septa
31 vent
32 filter material
34 rib (on back side of sheet 20)
35 rib (on front side of sheet 20)
36 rib (on front side of sheet 20)
37 channel bottom
38 flat tops
40 outer wall of the sample transfer tip 12
41 inner wall of the sample preparation chamber 10
43 sealing area of tip
45 air pocket
46 sealing area of chamber
50 plug
100 handling kit

The invention claimed is:

1. A disposable device for holding and processing a sample for use in an apparatus for analyzing a liquid sample by nucleic acid amplification, comprising:

a device body having:

(1) a sheet comprising a flat plane, the sheet comprising:

(i) a back side comprising a plurality of back side ribs disposed on the back side of the sheet, and (ii) a front side on which a structured surface is arranged, the structured surface comprising:

a plurality of unitary front side ribs configured to increase stiffness of the device body, the front side ribs comprising a width which is about 30% to about 300% of a thickness of the sheet and a height which is about 60% to about 200% of the thickness of the sheet, the front side ribs comprising:

flat tops, the plurality of front side ribs disposed on the front side of the sheet, (2) a sealing cover comprising a thickness of less than 1mm, the sealing cover attached to the flat tops of the front side ribs and covering the structured surface of the front side of the sheet, together comprising:

(i) one or more chambers one of which comprises a sample preparation chamber having an elongated concave body recessed into the front side of the sheet and comprising a cylindrical opening situated below the plane of the sheet, the cylindrical opening configured to receive a sample transfer tip, (ii) one or more channels one of which comprises an inlet channel connected to an amplification chamber for providing the amplification chamber with liquid, and (iii) one or more air pockets between the front side of the sheet and the sealing cover, the air pockets thermally insulating the front side of the sheet from the sealing cover.

2. The device according to claim 1, wherein at least one of the front side ribs is parallel with at least one element selected from the group consisting of: the inlet channel, at least one other channel of the device, and a wall of the amplification chamber of the device.

3. The device according claim 1, wherein one or more of the front side ribs define one or more walls of at least one of the channels.

4. The device according to claim 3, wherein opposing walls of the channel are formed by two of the front side ribs.

5. The device according to claim 4, wherein the channel has a bottom which is elevated with respect to a surface of the sheet adjacent to the two front side ribs which form opposing walls of the channel.

6. The device according claim 1, wherein the sealing cover is fixed to the flat tops of the front side ribs and touches the device body at less than all of the surface area of the sealing cover.

7. The device according to claim 1, wherein the sheet and the plurality of back side ribs and the plurality of the front side ribs are made of a plastic material.

8. The device according to claim 1, wherein the sealing cover is a foil sealed to the flat tops of the front side ribs arranged on the structured surface of the sheet.

* * * * *